US005249934A

United States Patent [19]

Merritt et al.

[11] Patent Number: 5,249,934

[45] Date of Patent: Oct. 5, 1993

[54] AIR CYCLE MACHINE WITH HEAT ISOLATION HAVING BACK-TO-BACK TURBINE AND COMPRESSOR ROTORS

[75] Inventors: Brent J. Merritt, Westfield, Mass.; Paul J. Dziorny, Manchester, Conn.

[73] Assignee: United Technologies Corporation, Hartford, Conn.

[21] Appl. No.: 819,412

[22] Filed: Jan. 10, 1992

[51] Int. Cl.[5] ..... F04B 17/00

[52] U.S. Cl. ..... 417/406; 62/402

[58] Field of Search ..... 417/405, 406; 62/401, 62/402

[56] References Cited

U.S. PATENT DOCUMENTS

| | | | |
|---|---|---|---|
| 2,492,672 | 12/1949 | Wood | 62/402 |
| 3,428,242 | 2/1969 | Rannenberg | 62/402 |
| 4,260,339 | 4/1981 | Lofts | 417/406 |
| 4,312,191 | 1/1982 | Biagini . | |
| 4,482,303 | 11/1984 | Acosta | 417/406 |

OTHER PUBLICATIONS

Modern Plactics Encyclopedia, McGraw-Hill, Oct. 1988. vol. 65, No. 11. pp. 78, 83, 135, 195-196, and 198-199.

*Primary Examiner*—Richard A. Bertsch
*Assistant Examiner*—Timothy S. Thorpe

[57] ABSTRACT

An air cycle machine (10) a plurality of wheels mounted on a common shaft (20) for rotation therewith about a longitudinal axis (12), including a compressor rotor (60) and a turbine rotor (50) mounted to a central portion (20c) of the shaft in back to back relationship, the turbine rotor (50) being operative to extract energy from a flow of compressed air for driving the shaft (20), and the compressor rotor (60), in rotation about the axis. The compressor rotor (60) and the compressor outlet flow passing through duct (164) are thermally isolated from the turbine rotor (50) and the turbine inlet flow passing through duct (152), respectively, by an annular disc-like member (14) of a low thermal conductivity, fiber reinforced resin composite disposed about the shaft 20 and extending radially outwardly between the turbine rotor (50) and the compressor rotor (60).

13 Claims, 2 Drawing Sheets

AIR CYCLE MACHINE WITH HEAT ISOLATION HAVING BACK-TO-BACK TURBINE AND COMPRESSOR ROTORS

TECHNICAL FIELD

The present invention relates generally to air conditioning systems for cooling and dehumidifying air for supply to an aircraft cabin or like enclosure and, more particularly, to an air cycle machine having a turbine rotor and a compressor rotor mounted on a common drive shaft in back-to-back relationship.

BACKGROUND ART

Conventional aircraft environmental control systems incorporate an air cycle machine, also referred to as an air cycle cooling machine, for use in cooling and dehumidifying air for supply to the aircraft cabin for occupant comfort. Such air cycle machines may comprise two, three or four wheels disposed at axially spaced intervals along a common shaft, and defining a compressor rotor, a turbine rotor, and one or two additional rotors, for example a fan rotor or an additional turbine rotor or an additional compressor rotor, the turbine or turbines driving both the compressor and the fan. The wheels are supported for rotation about the axis of the shaft on one or more bearing assemblies disposed about the drive shaft. Although the bearing assemblies may be ball bearings or the like, hydrodynamic film bearings, such as gas film foil bearings, are often utilized on state-of-the-art air cycle machines.

Each wheel may comprise only a single rotor, such as, for example, disclosed in commonly assigned U.S. Pat. No. 3,428,242. The three wheel air cycle machine disclosed therein comprises a fan rotor, a turbine rotor and a compressor rotor mounted to a common shaft, with the fan rotor being disposed at one end of the shaft and the turbine and compressor rotors being disposed at the other end of the shaft. The shaft is supported for rotation on a ball bearing assembly disposed intermediate the fan and the turbine and cooled by turbine outlet air. The compressor rotor and the turbine rotor are disposed in back to back relationship on opposite sides of a central plate with the turbine inboard of the compressor. The central plate disposed between the turbine and compressor rotors forms part of the housing encasing the turbine and compressor rotors and defining separate inlet and outlet ducts for the turbine rotor and the compressor rotor. In this arrangement, the central plate is exposed on its outboard side to relatively warmer air being ducted from the compressor rotor and is simultaneously exposed on its inboard side to relatively cooler air being ducted to the turbine rotor.

It is also known in the art for a single wheel to comprise a dual rotor, that is for a single wheel to provide two back-to-back rotors either formed integrally as one piece or integrally mounted together. For example, U.S. Pat. No. 4,312,191, discloses an air cycle machine including a dual rotor wheel mounted on a bearing assembly disposed about an axially extending shaft. This dual rotor wheel comprises a turbine disk and a compressor disk disposed in back-to-back relationship with the compressor disk integrally secured to the turbine disk. The dual rotor wheel is disposed within a housing defining the flow ducts to and from the compressor and turbine rotors and having a central annular plate portion which separates the turbine inlet flow duct from the compressor outlet flow duct. The central plate may be an integral part of the housing or formed by mating two housing segments together to encase the dual rotor wheel. In either case, the central plate is exposed on one side to relatively warmer air being ducted from the compressor rotor, while simultaneously being exposed on its other side to relatively cooler air being ducted to the turbine rotor.

On aircraft powered by turbine engines, the air to be conditioned in the air cycle machine is typically compressed air bled from one or more of the compressor stages of the turbine engine. In conventional systems, this bleed air is passed through the air cycle machine compressor wherein it is further compressed, thence passed through a condensing heat exchanger to cool the compressed air sufficiently to condense moisture therefrom thereby dehumidifying the air before expanding the dehumidified compressed air in the turbine of the air cycle machine to both extract energy from the compressed air so as to drive the shaft and also to cool the expanded turbine exhaust air before it is supplied to the cabin as conditioned cooling air.

The compressed bleed air being supplied to the compressor of the air cycle machine is typically supplied at a temperature of about 105 C. to about 120 C., but raised in temperature during the compression process to a temperature typically in the range about 150 C. to about 175 C. The temperature of the compressed air is thereafter reduced prior to being delivered to the turbine for expansion therein to a temperature typically in the range of about 40 C. to about 50 C. to dehumidify the air, and thence further cooled in the expansion process to a temperature typically less than 5 degrees Celsius above the freezing point of 0 C. Consequently, when the compressor rotor and turbine rotor are disposed in back-to-back relationship with their flow ducts separated by a central plate, the temperature differential across the central plate may range from 80 to 125 degrees Celsius.

Conventionally, the housing, central plate, and rotors of aircraft air cycle machines are made of a light-weight metal, typically aluminum, strong enough to withstand the fluid pressure encountered during operation, but light-weight so as to minimize the impact on fuel consumption during flight. Aluminum, however, has a high thermal conductivity. Thus, an undesireable consequence of this temperature differential across the central plate is heat transfer from the relatively warmer air flow on the compressor side of the central plate, via conduction through the thermally conductive central plate, to the relatively cooler air flow on the turbine side of the central plate, thereby reducing the effective cooling efficiency of the expansion process. Since cooling the air flow is the primary function of the expansion turbine, this undesireable heat transfer resulting from the close proximity of the back-to-back compressor and turbine rotors detracts from the attractiveness of such a back-to-back arrangement, which is generally otherwise desireable as a means of minimizing the overall length, and therefore weight, of the air cycle machine.

DISCLOSURE OF INVENTION

It is an object of the present invention to provide an air cycle machine having back-to-back compressor and turbine rotors wherein the turbine air flow circuit is thermally isolated from the compressor air flow circuit so as to retard heat transfer from the relatively warmer compressor outlet air flow to the relatively cooler turbine inlet air flow.

It is an additional object of a particular embodiment of the present invention to provide an air cycle machine having back-to-back compressor and turbine rotors wherein the turbine and compressor rotors are thermally isolated from each other thereby retarding heat transfer from the relatively warmer compressor air flow to the relatively cooler turbine air flow.

It is a further object of a specific embodiment of the present invention to provide an air cycle machine wherein a thermal insulating annular disk-like member made of a low thermal conductivity fiber reinforced resin material is disposed with a radially inward portion between and in spaced relationship from the back-to-back compressor and turbine rotors and a radially outward portion extending between the turbine inlet duct and the compressor outlet duct.

The air cycle machine of the present invention comprises a turbine rotor and a compressor rotor disposed in back-to-back relationship on a common shaft means for rotation therewith about a longitudinal axis and encased in a housing defining a turbine flow circuit and a compressor flow circuit, these flow circuits being separated over at least a portion of the extent over which the compressor outlet duct lies adjacent to the turbine inlet duct by a thermal insulating member disposed therebetween. The thermal insulating member advantageously comprises an annular disk-like member made of a relatively poor heat conducting material whereby heat transfer across the common annular member from a relatively warmer fluid passing from the compressor rotor through the compressor outlet duct to a relatively cooler fluid passing into the turbine rotor through the turbine inlet duct is retarded.

In a particularly advantageous embodiment of the present invention, a radially inner root portion of the common annular member is disposed intermediate the disk of the compressor rotor and the disk of the turbine rotor in spaced relationship therebetween and a radially outer portion of the common annular member extends between the inlet duct of the turbine flow circuit and the outlet duct of the compressor flow circuit radially outward to the housing. To minimize the pressure differential across the root portion of the annular thermal insulating member, a small amount of turbine inlet air flow may be passed through the volume formed between the backside of the turbine rotor and the root portion of the thermal insulating member and a small amount of compressor outlet air flow may be passed through the volume formed between the backside of the compressor rotor and the root portion of the thermal insulating member. Thus, as the pressure differential imposed across the common annular member is thereby minimized over its entire extent, the common annular member may be made of a relatively low strength material, such as a ceramic material or a non-metallic composite material having a thermal conductivity material at least about an order of magnitude less than the thermal conductivity of aluminum, for example a fiber reinforced matrix of low thermal conductivity resin.

BRIEF DESCRIPTION OF DRAWING

These and other objects, features and advantages of the present invention will become more apparent in light of the detailed description of the embodiment thereof illustrated in the accompanying drawing, wherein.

BEST MODE FOR CARRYING OUT THE INVENTION

Figure 1:
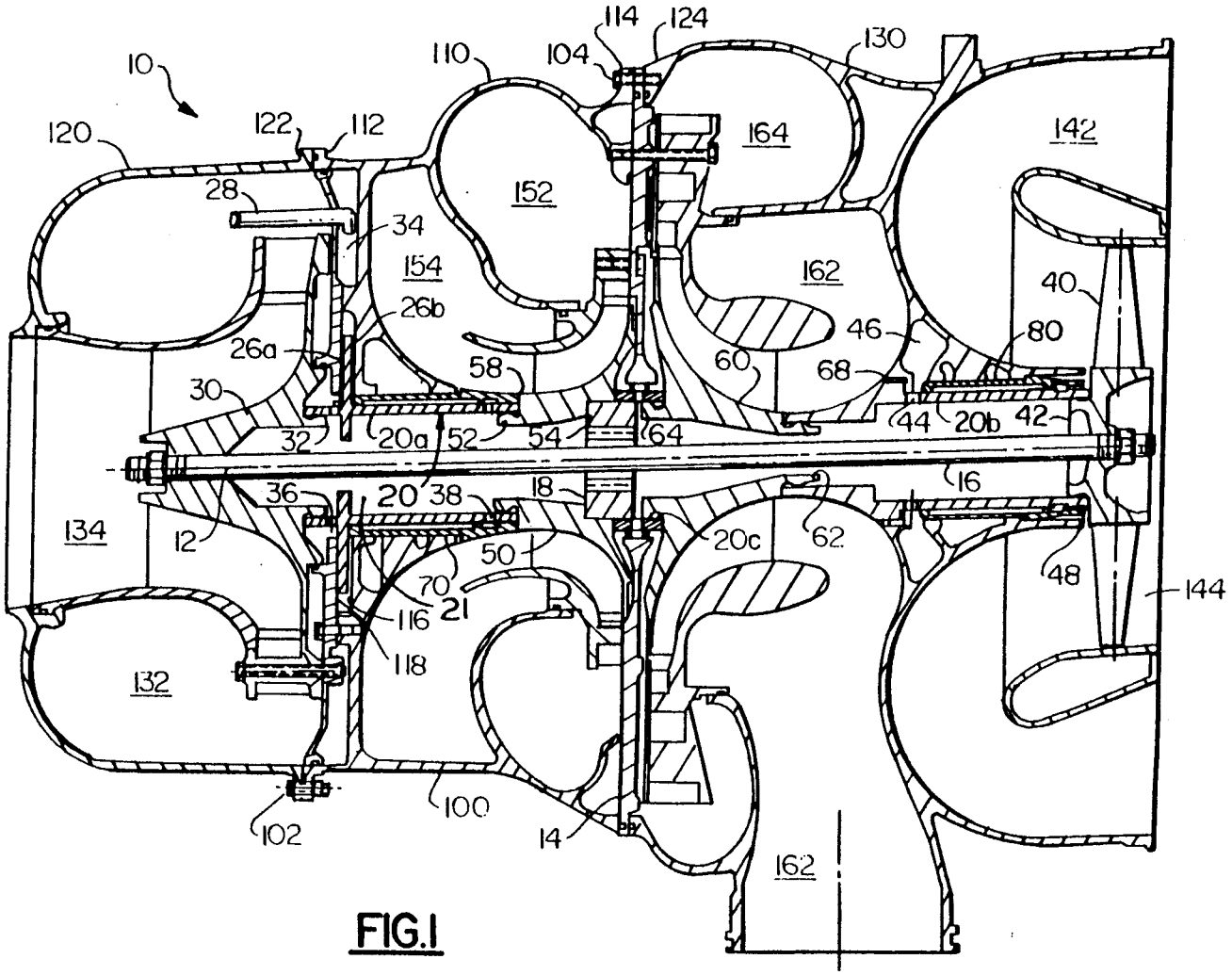
FIG. 1 is a side elevational view, partly in section, of a four wheel air cycle machine incorporating the present invention.

Referring now to FIG. 1, there is depicted therein an air cycle machine 10 having four distinct wheels coaxially disposed along a common shaft means 20 for rotation about a common longitudinal axis 12. A first wheel 30 is mounted to a first end portion **20*a* of the shaft means 20 for rotation therewith, a second wheel 40 is mounted to a second end portion 20*b* of the shaft means 20 for rotation therewith, a third wheel 50 is mounted to a central portion 20*c* of the shaft means 20 in spaced relationship from the first wheel 30 and the second wheel 40 for rotation therewith, and a fourth wheel 60 is also mounted to the central portion 20*c* of the shaft means 20 for rotation therewith in back-to-back relationship with the third wheel 50 and between the second wheel 40 and the third wheel 50. The shaft means 20 is supported for rotation about the longitudinal axis 12 on a pair of spaced bearing means 70 and 80 supported in a housing 100** which serves not only to support the bearing means, but also to provide appropriate inlet ducts and outlet ducts for the supply of working fluid to and the discharge of working fluid from each of the four wheels.

In the air cycle machine 10 embodying the present invention, one of the two wheels mounted to the central portion **20*c* of the shaft means 20, that is either the third wheel 50 or the fourth wheel 60, comprises a compressor rotor operative to compress a flow of gaseous working fluid and the other of the central wheels comprises a turbine rotor operative to expand the gaseous working fluid compressed via the compressor rotor thereby extracting energy therefrom so as to drive the shaft means 20 in rotation about the axis 12 and thereby power the compressor rotor. The two outer wheels, that is the first wheel 30 and the second wheel 40, may each comprise a fan rotor, or one may comprise an additional turbine rotor and the other a fan rotor, or one may comprise an additional turbine rotor and the other an additional compressor rotor, as desired. In fact, the wheels of an air cycle machine embodying the present invention may comprise any rotor combination having at least one turbine rotor and at least one compressor rotor wherein the turbine rotor and the compressor rotor are mounted on a common shaft in back-to-back relationship, with the turbine rotor extracting sufficient energy from the gaseous working fluid expanded therein to drive the shaft means 20, and the compressor rotor, and any other rotor or rotors, as the case may be, mounted on the common shaft means 20 in rotation therewith about the axis 12**.

Each of the shaft members **20*a*, 20*b* and 20*c* comprise an annular sleeve defining an open ended hollow central cavity. The end shaft members 20*a* and 20*b* are supported for rotation about the longitudinal axis 12 on bearing means 70 and 80, respectively. Each of the four wheels 30, 40, 50 and 60 is a rotor comprising a hub portion and a plurality of rotor blades extending outwardly from the hub portion. The hub portion of each rotor has a central opening extending axially therethrough to accommodate an elongated tie rod 16 extending along the longitudinal axis 12 through the central axial openings in the four wheels and through the hollow cavities of the shaft members. The tie rod 16 is bolted up at its ends to the outer wheels 30, 40** to axially clamp the four wheels and the shaft members together with sufficient axial clamping load that all four wheels and all shaft members rotate together as one integral wheel and shaft assembly.

The first end wheel 30 is mounted to the outboard end of the first end shaft member 20*a* and the second end wheel 40 is mounted to the outboard end of the second end shaft member 20*b*. The central wheel 50 is mounted to the inboard end of the first end shaft member 20*a* and the central wheel 60 is mounted to the second end shaft member 20*b*. The two central wheels 50 and 60 are additionally mounted to the central shaft member 20*c* for rotation therewith and disposed in back to back relationship on opposite sides of an annular disk-like member 14 having a central opening circumscribing the central shaft member 20*c* and extending radially outwardly therefrom. Each of the wheels 30, 40, 50 and 60 is mounted to its respective end shaft member 20*a*, 20*b* by an interference fit between a piloting rim 32, 42, 52, 62, respectively, extending axially outwardly from the wheel hub, and the inner wall of the shaft member bounding the central cavity thereof into which cavity the rim is precisely piloted, thereby ensuring that the wheels and the shaft members rotate together about the axis 12.

Figure 2:
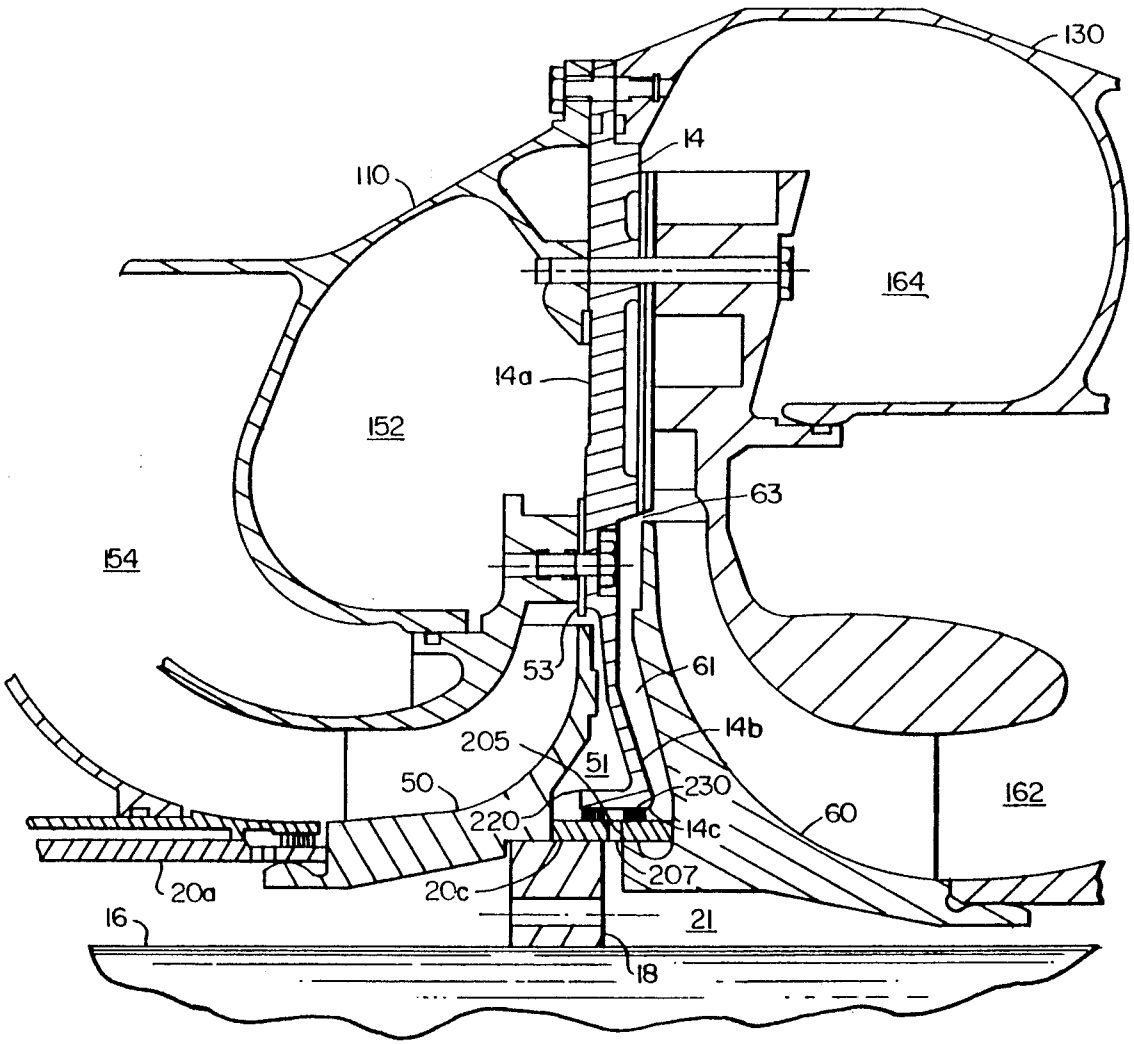
FIG. 2 is an enlarged side elevational view, partly in section, of the region 2—2 of the embodiment of the present invention illustrated in FIG. 1.

Alternate methods of mounting the wheels to the shaft members be may used in constructing the air cycle machine 10. For example, as best seen in FIG. 2, the third wheel 50 is not mounted to the central shaft member 20*c* by means of a piloting rim, but rather is mounted to the central shaft member 20*c* through a pilot bushing 18 coaxially disposed about the axis 12. The hub of the third wheel 50 has a central piloting socket 54 sized to receive and retain by interference fit one end of the pilot bushing 18. The other end of the pilot bushing 18 is received into one end of the central cavity of the central shaft member 20*c* and retained therein by interference fit with the inner wall of the central shaft member 20*c*. The fourth wheel 60 is mounted to the central shaft member 20*c* through a piloting rim 64 which is received into the other end of the central cavity of the central shaft member 20*c* and retained therein by interference fit with the inner wall thereof. The four wheels and the three shaft shaft members to which they are so mounted are axially loaded together by the tie rod 16 extending coaxially therethrough, thereby ensuring that the four wheels and the three shaft members rotate together about the longitudinal axis 12 as a single assembly. The pilot bushing 18 also serves to center the entire wheel and shaft assembly coaxially about the tie rod 16.

The wheel and shaft assembly is disposed within a housing 100 which provides individual inlet and outlet ducts for each of the rotors and also provides support for the bearing means 70 and 80. The housing 100 may advantageously be comprised of two or more sections to facilitate assembly. The bearing means 70 and 80 radially supporting the shaft and wheel assembly for rotation about the longitudinal axis 12 may comprise hydrodynamic journal bearings, such as for example gas film foil journal bearings of the type disclosed in commonly assigned U.S. Pat. Nos. 4,133,585; 4,247,155; and/or 4,295,689. The hydrodynamic journal bearing 70 is disposed about the first end shaft member 20*a* between the first wheel 30 and the third wheel 50, and the hydrodynamic journal bearing 80 is disposed about the second end shaft member 20*b* between the second wheel 40 and the fourth wheel 60. Each of the hydrodynamic bearings 70 and 80 comprises an inner race mounted to its respective shaft member, an outer race disposed coaxially about the inner race in radially spaced relationship therefrom and supported in the housing 100 to restrict axial or rotational displacement of the outer race, and a foil pack disposed in an annular space formed between the radially spaced inner and outer races through which pressurized air is passed to provide the appropriate hydrodynamic forces necessary for the journal bearings 70 and 80 to support the shaft and wheel assembly for rotation about longitudinal axis 12.

Additionally, a hydrodynamic thrust bearing 26 is provided for axially supporting the shaft and wheel assembly of the air cycle machine 10. The hydrodynamic thrust bearing may comprise a gas film foil thrust bearing, such as for example of the type disclosed in commonly assigned U.S. Pat. Nos. 4,082,325; 4,116,503; 4,247,155 and/or 4,462,700. The bearing 26 includes an outboard bearing member 26*a* and an inboard bearing member 26*b* operatively disposed on opposite sides of a thrust disc 90 extending outwardly from the first end shaft member 20*a* intermediate an end wall 116 of the central housing section 110 and a bearing plate 118 disposed between the central housing section 110 and the first end section 120 inboard of the outboard first wheel 30.

In the air cycle machine 10 as illustrated in the drawing, the central third wheel 50 comprises a first stage turbine rotor, the central fourth wheel 60 comprises a compressor rotor, the outboard first wheel 30 comprises a second stage turbine rotor, and the outboard second wheel 40 comprises a fan rotor. The first and second stage turbine rotors 30 and 50 serve not only to expand and cool the air being conditioned, but also extract energy from the air being expanded for rotating the entire wheel and shaft assembly so to drive the fan rotor 40 and the compressor rotor 60. This embodiment of the air cycle machine 10 is particularly suited for use in a condensing cycle air conditioning and temperature control system for cooling and dehumidifying air for supply to an enclosure for occupant comfort, such as the condensing cycle environmental control system for supplying cooled and dehumidified air to the cabin of an aircraft as disclosed in commonly assigned, co-pending application Ser. No. 07/570,100, filed Aug. 17, 1990, now U.S. Pat. No. 5,086,622 which is hereby incorporated by reference.

In the illustrated embodiment of the air cycle machine 10, the housing 100 is comprised of three sections: a central section 110 surrounding the turbine rotor 50 and providing a first stage turbine inlet duct 152 circumscribing the turbine rotor 50 radially outwardly thereof for supplying air to the turbine rotor 50 to be expanded therein and providing a first stage turbine outlet duct 154 axially adjacent the outlet of the turbine rotor 50 for discharging the exhaust air expanded in the turbine rotor 50, a first end section 120 surrounding the turbine rotor 30 and providing a second stage turbine inlet duct 132 for supplying air to the turbine rotor 30 to be expanded therein and an axially directed second stage turbine outlet duct 134 for discharging the exhaust air expanded in the turbine rotor 30, and a second end section 130 surrounding both the compressor rotor 60 and the fan rotor 40 and providing an inlet duct 162 axially adjacent the inlet to the compressor rotor 60 for supplying air to the compressor rotor 60 to be compressed therein, an outlet duct 164 circumscribing the compressor rotor 60 radially outwardly thereof for discharging air compressed via the compressor rotor 60, an inlet duct 142 for directing ram cooling air to the fan rotor 40 and an axially directed outlet duct 144 for discharging ram cooling air having passed through the fan rotor 40. The central housing section 110 is mounted at one of its ends to the first end housing section 120 by a plurality of circumferentially spaced bolts 102 attaching a flange 112 of the central section 110 to a flange 122 of the end section 120, and at its other end to the second end housing section 130 by a plurality of circumferentially spaced bolts 104 passing through the annular disc-like member 14 to attach flange 114 of the central section 110 to flange 124 of the end section 130.

To cool and pressurize the thrust bearing 26 and the journal bearings 70 and 80 during operation, relatively cool, pressurized air from the second stage turbine inlet duct 132 is passed through a flow tube 28 into an annular chamber 34 located between the bearing plate 118 and the end wall 116. A first portion of this cool pressurized air flows therefrom through the outboard thrust bearing member **26*a* to pressurize and cool this bearing member and thence through openings 36 in the outboard end portion of the first end shaft member 20*a* into the hollow interior cavity 21 thereof. A second portion of this cool pressurized air flows from the chamber 34 through the inboard thrust bearing member 26*b* and thence through the first journal bearing 70 to cool and pressurize both of these hydrodynamic bearings. After traversing the first journal bearing 70, this second portion of the cool pressurized air passes through openings 38 in the inboard end portion of the first end shaft member 20*a* into the hollow interior cavity 21 thereof to remix with the first portion of this flow. The recombined flow thence passes through the hollow interior of the shaft and wheel assembly to pass through openings 44 in the inboard end portion of the second end shaft member 20*b* to enter a chamber 46 from which this cool pressurized air passes through the second journal bearing 80, thereby cooling and pressuring the second hydrodynamic journal bearing 80, before exiting past seal 48, such as a labyrinth seal, into the duct 142. Additional seals 58 and 68, also depicted as labyrinth, are provided to prevent the bearing cooling and pressurizing air from escaping the bearing flow circuit. Seal 58, which is disposed between the inboard end portion of the first end shaft member 20*a* and the inboard end of the first journal bearing 70, allows a limited flow of higher pressure, cool air from the first stage turbine outlet duct 154 to leak into the bearing flow circuit thus sealing the first journal bearing 70, and seal 68, which is disposed between the inboard end portion of the second end shaft member 20*b* and the surrounding housing, allows a limited flow of higher pressure, relatively cool air to leak from the compressor inlet duct 162 into the chamber 46 thereby sealing the second journal bearing 80**.

Referring now particularly to FIG. 2, the annular disc-like member 14 is disposed about the central shaft member **20*c* and extends therefrom outwardly between the central housing section 110 and the second housing section 130 to separate the air flow circuit associated with the compressor rotor 60 from the air flow circuit associated with the turbine rotor 50 over at least a substantial part of their extent. In accordance with the present invention, the annular disk-like member 14 comprises a relatively poor heat conducting member whereby heat transfer across the annular disk-like member 14 from a relatively warmer fluid passing into and out of the compressor rotor 60 to a relatively cooler fluid passing into and out of the turbine rotor 50** is retarded. By relatively poor heat conducting member it is meant that the annular disk-like member has a thermal conductivity which is at least about an order of magnitude lower than the thermal conductivity of conventional metals, typically aluminum, from which aircraft air cycle machine components are made.

In the embodiment of the present invention incorporated into the air cycle machine 10, a radially inner portion **14*a* of the annular disk-like member is disposed between the backside of the compressor rotor 60 and the backside of the turbine rotor 50 and a radially outer portion 14*b* of the annular disk-like member extends radially outward between the inlet duct 152 of the turbine flow circuit and the outlet duct 164 of the compressor flow circuit and is mounted at its outer end to the housing 110. In such an embodiment, the pressure differential imposed across the radially outward portion 14*b* of annular disk-like member 14 is thereby minimized, the pressure of the air flow in the turbine inlet duct 152 being only slightly less, typically by only a few psi, than the pressure of the air flow in the compressor outlet duct 164 due to pressure losses experienced as the air flows through flow conduits (not shown) from the the compressor outlet duct 164 to the turbine inlet duct 152** and through an intermediate heat exchanger (not shown) traversed therebetween.

In accordance with a further aspect of the present invention, the compressor rotor 60 and the turbine rotor 50 do not abut each other in back-to-back relationship, but rather the radially inward portion **14*a* of the annular disk-like member 14 extends radially outwardly from the central shaft member 20*c* between the turbine rotor 50 and the compressor rotor 60 thereby thermally insulating the backside of the turbine rotor 50 and the compressor rotor 60 to retard heat transfer from the compressor rotor per se, which is exposed to the warmer compressor air flow, directly to the turbine rotor per se and therefrom to the cooler turbine air flow being expanded therein. Additionally, to reduce heat transfer from the compressor rotor per se to the turbine rotor per se through the central shaft sleeve 20*c* to which both the compressor and turbine rotors are mounted, the central shaft sleeve 20*c*** may comprise a relatively thin walled, elongated sleeve made of a structural steel alloy having a thermal conductivity lower than than the thermal conductivity of the material from which the rotors are made, which is typically aluminum.

Advantageously, the radially inward root portion **14*a* of the annular disk-like member 14 separating the back-to-back rotors 50 and 60 may be disposed therebetween in spaced relationship with both the turbine rotor 50 and the compressor rotor 60 so as to provide a first volume 61 between member 14 and the backside of the compressor rotor 60 and a second volume 51 between member 14 and the backside of the turbine rotor 50. The annular volumes 51 and 61 may be pressurized and the flow of warmer compressor outlet air along the backside of the compressor rotor 60, shaft 20*c* and the backside of the turbine rotor 50 into the cooler turbine inlet air substantially precluded by venting compressor outlet air and turbine inlet air into an annular volume 205 formed about-the central shaft 20*c* member between a seal means 55 disposed between the shaft sleeve 20*c* and the radially inner end surface 14c of the annular disk-like member 14 and a seal means 65 disposed between the shaft sleeve 20c and the end surface 14c. The annular volume 205 is connected via holes 207 in fluid communication to the interior cavity 21 of the shaft means 20 which is maintained at a pressure lower than that of the turbine inlet air and the compressor outlet air. In operation, a limited flow of turbine inlet air passes from the inlet of the turbine rotor 50 through a gap 53 into the volume 51, while a limited flow of compressor outlet air passes from the outlet of the compressor rotor 60 through a gap 63 into the volume 61 and leak therefrom past seal means 55 and 65, respectively, into the annular volume 205 and thence into the hollow interior of the shaft means 20 through vent holes 207 spaced the circumference of the central shaft sleeve 20c. Thereafter, the vented air flows mix with the bearing air flow passing through the interior cavity 21 of the shaft means and pass through the second journal bearing 80 before exiting through seal 48 into duct 142. The seal means 55 and 65, which may for example be labyrinth-like knife edge seals, disposed in sealing relationship intermediate the outer surface of the central shaft sleeve 20c and the inboard end 14c of the root portion 14b of the annular disk-like member 14 function to limit the amount of flow passing from the volumes 51 and 61, respectively, into the annular volume 205** to a relatively low leakage flow. A more detailed discussion of this sealing and venting means is presented in commonly assigned copending application docket No. H2086-EC, filed of even date.

With the pressure differential across the annular disk-like member 14 maintained relatively low over its entire extent, as for example via the aforementioned construction, the thermal insulating material comprising the annular disk-like member 14 may be a relatively low strength, low thermal conductivity, insulating material, such as a non-metallic composite or ceramic material. Accordingly, the annular disk-like member 14 may advantageously be formed of a fiber reinforced, thermosetting resin material, such as an epoxy, polyimide or like resin matrix reinforced with fiberglass, graphite, aramid or like fibers, with the resin selected to give the desired low thermal conductivity and the fiber selected to give the required strength. For example, the annular disk-like member 14 may comprise a body of a polyimide resin matrix, such as HyComp-M310 resin from Dexter Composites, reinforced with graphite fibers to provide improved strength.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

We claim:

1. An air cycle machine for conditioning air for supply to an enclosure, said air cycle machine comprising:

shaft means supported for rotation about a longitudinally extending axis;

a compressor wheel mounted to said shaft means for rotation therewith for compressing air delivered thereto;

a turbine wheel mounted to said shaft means for expanding compressed air from said compressor wheel thereby extracting energy to drive said shaft means in rotation about the axis, said turbine wheel and said compressor wheel disposed in back-to-back relationship;

a turbine inlet duct circumscribing said turbine wheel for directing a flow of relatively cooler air into said turbine wheel to be expanded in said turbine wheel;

a compressor outlet duct circumscribing said compressor wheel for discharging a flow of relatively warmer air passing out of said compressor wheel;

said turbine wheel and said turbine inlet duct defining a turbine circuit and said compressor wheel and said compressor outlet defining a compressor circuit;

means for thermally isolating said turbine circuit from said compressor circuit for retarding heat transfer from the relatively warmer air traversing said compressor circuit to the relatively cooler air traversing said turbine circuit;

said thermally isolating means including a thermally insulating plate extending radially substantially the extent of said turbine circuit and said compressor circuit; and said shaft means including a shaft sleeve supporting said turbine wheel and said compressor wheel being fabricated from material having a lower heat conductivity than the material of said turbine wheel and said compressor wheel.

2. An air cycle machine as recited in claim 1 wherein said thermally insulating plate comprises an annular disk-like member made of a low conductivity material.

3. An air cycle machine as recited in claim 2 wherein said thermally insulating plate comprises an annular disk-like member made of a low thermal conductivity resin reinforced with strength enhancing fibers.

4. An air cycle machine as recited in claim 3 wherein said strength enhancing fibers are selected from the group consisting of fiberglass, graphite and aramid fibers.

5. An air cycle machine as recited in claim 3 wherein said low conductivity resin is a polyimide resin.

6. An air cycle machine as recited in claim 5 wherein said strength enhancing fibers are selected from the group consisting of fiberglass, graphite and aramid fibers.

7. An air cycle machine as recited in claim 1 wherein said thermally insulating plate is an annular disk-like member made of low thermal conductivity material, means for maintaining a low pressure drop across said thermally insulating plate, said annular disk-like member having a radially inward portion disposed about said shaft means and extending between said turbine wheel and said compressor wheel and a radially outward portion extending between said inlet duct and a radially outward portion extending between said inlet duct and said outlet duct, whereby said low pressure drop maintaining means allows the use of said low thermal conductivity material to permit close proximity to said turbine wheel and said compressor wheel and thereby minimize the length of said shaft means.

8. An air cycle machine as recited in claim 7 wherein said low pressure drop maintaining means comprises said annular disk-like member being disposed about said shaft means with the radially inward portion thereof extending in spaced relationship between said turbine wheel and said compressor wheel thereby defining a first volume between said turbine wheel and the radially inward portion of said annular disk-like member and a second volume between said compressor wheel and the radially inward portion of said annular disk-like member.

9. An air cycle machine as recited in claim 8 further comprising means for passing air from the inlet duct of said turbine wheel into the first volume and the air from the outlet duct of said compressor wheel into the second volume.

10. An air cycle machine as recited in claim 8 wherein said annular disk-like member is made of a low thermal conductivity resin reinforced with strength enhancing fibers.

11. An air cycle machine as recited in claim 10 wherein said strength enhancing fibers are selected from the group consisting of fiberglass, graphite and aramid fibers.

12. An air cycle machine as recited in claim 10 wherein said low conductivity resin is a polyimide resin.

13. An air cycle machine as recited in claim 12 wherein said strength enhancing fibers are selected from the group consisting of fiberglass, graphite and aramid fibers.

* * * * *